US006453656B1

(12) United States Patent
Nakayama

(10) Patent No.: US 6,453,656 B1
(45) Date of Patent: Sep. 24, 2002

(54) PIECING METHOD AND PIECING DEVICE FOR THE SPINNING MACHINE

(75) Inventor: Noboru Nakayama, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/976,149

(22) Filed: Oct. 15, 2001

(30) Foreign Application Priority Data

Nov. 15, 2000 (JP) ..... 2000-348620

(51) Int. Cl.[7] ..... D01H 13/26
(52) U.S. Cl. ..... 57/261
(58) Field of Search ..... 57/261, 264, 333, 57/350, 341, 343, 344, 315

(56) References Cited

U.S. PATENT DOCUMENTS 5,419,110 A * 5/1995 Mikami et al. ..... 57/261
5,511,373 A * 4/1996 Banba ..... 57/261
5,704,204 A * 1/1998 Mima et al. ..... 57/261
5,802,831 A * 9/1998 Imamura ..... 57/261
5,809,764 A * 9/1998 Baba ..... 57/261
5,813,209 A * 9/1998 Hirao et al. ..... 57/22
5,934,058 A * 8/1999 Hirao et al. ..... 57/261
6,029,435 A * 2/2000 Okamoto et al. ..... 57/261
6,209,304 B1 * 4/2001 Feuerlohn et al. ..... 19/228

FOREIGN PATENT DOCUMENTS

JP 9-268446 10/1997

* cited by examiner

*Primary Examiner*—Danny Worrell
(74) *Attorney, Agent, or Firm*—Armstrong, Westerman & Hattori, LLP

(57) ABSTRACT

The object of the present invention is to provide a piecing method and a piecing device of a spinning machine capable of blowing off the sliver effectively during piecing and controlling the joint thickness. Accordingly, a means is provided for sucking by guiding to the suction pipe 34 disposed between the twisting device 17 and the draft device 10 by blowing pressurized air to the sliver S so as to carry out piecing of the leading yarn Y fed back to the twisting device 17 and the sliver S from the draft device 10. The pressurized air is blown from the periphery of the spinning nozzle 22 of the twisting device 17 in opposition toward the sliver from the draft device.

3 Claims, 7 Drawing Sheets

PIECING METHOD AND PIECING DEVICE FOR THE SPINNING MACHINE

FIELD OF THE INVENTION

The present invention relates to a piecing method and a piecing device for piecing a severed spun yarn on the winding package side and the sliver of a spinning machine for drafting a sliver and then winding to a winding package after spinning by a twisting device of such as a pneumatic type.

BACKGROUND OF THE INVENTION

First, the structure of the relevant part of the spinning machine will be described with reference to FIG. 8.

Referring to FIG. 8, 10 is a draft device, and a back roller 11, a third roller 12, a middle roller 13 laid across an apron belt 14, and a front roller 15 are formed in this order from the upstream side. A sliver S from a first sliver guide 16 on the upstream side of the back roller 11 is drafted in a designated drafting ration between each roller and is supplied to a twisting device 17. A second sliver guide 16*a* is provided between the third roller 12 and the middle roller 13.

The twisting device 17 comprises a guide hole (fiber introducing hole) 20 for guiding a fiber bundle F drafted in the draft device 10 to a guide member 18 located opposing to the tip of a hollow guide shaft member 25 to be mentioned later on, a spinning nozzle 22 with a nozzle hole 21 for generating whirling air flow in the tip (spinning point) of the hollow guide shaft member 25 to be mentioned later on, a nozzle block 24 for holding the spinning nozzle 22 and forming an air room 23, the hollow guide shaft member 25 wherein the tip is provided facing the spinning nozzle 22, and a holding member 26 for closing the air room 23 by joining to the nozzle block 24, and which holds on the hollow guide shaft member 25, and separates the hollow guide shaft member 25 with respect to the spinning nozzle 22 during a yarn breakage.

The fiber bundle F drafted by the draft device 10 is guided along the guide member 18 from the guide hole 20, and then enters inside the hollow guide shaft member 25. The end of the fiber, the tip of which is released from the nip at the front roller 15 at the time being, is whirled by the whirling flow injected from the nozzle hole 21, is wound by reversing on the tip section of the hollow guide shaft member 25, and is sucked in while winding onto the fiber entering the hollow guide shaft member 25, to be a spun yarn Y like a true twist of which the most part of the fiber is to be a wrapping fiber. Moreover, the spun yarn Y is wound to the winding package (not shown in the drawings) by passing between a delivery roller 28 and a nip roller 29 contacting with the delivery roller 28 which compose the yarn feeding device on the downstream side of the twisting device 17.

Between the draft device 10 and the twisting device 17, an air shower tube 32 for blowing pressurized air to the sliver S during piecing, and a suction pipe 34 for holding the spun yarn at the winding package side and sucking the fiber blown off by the pressurized air from the air shower tube 32, are provided.

Next, the conventional piecing operation after the yarn breakage will be described in reference to FIG. 9 through FIG. 10.

When yarn breakage occurs, the back roller 11 and the third roller 12 which are a part of the draft rollers composing the draft device 10 are stopped, and the middle roller 13 and the front roller 15, which are on the downstream side are maintained in a driving state. At that time, the yarn feeding by the delivery roller 28 and the nip roller 29 is also maintained at a driving state for a while. As a result, as shown in FIG. 9, the sliver S is broken by the driving middle roller 13, and the sliver S stops with the tip section Sa positioned between the third roller 12 and the middle roller 13. At this time, the tip section Sa of the sliver S is held by the second sliver guide 16*a*.

Following the stopping of a part of the draft rollers of the draft device 10, the driving (compressed air injection from the nozzle hole 21) of the twisting device 17 is stopped while the hollow guide shaft member 25 is transferred to a state in which it is separated from the nozzle block 24. Under such condition, preceding the piecing operation, the nip roller 29 is separated from the delivery roller 28 and the yarn feeding is stopped. Subsequently, the spun yarn Y at the winding package side is held by a yarn feeding roller 30 which comprises the yarn delivering member, and is fed back to the yarn discharging side of the twisting device 17 by being passed through the nip roller 29 and the delivery roller 28. Then, by the rotation of the yarn feeding roller 30, the spun yarn Y is fed toward the draft device 10, and in cooperation with the air flow (not shown in the drawings) toward the fiber bundle inlet of the guide hole 20, as a leading yarn Y (parent yarn), is passed through, in the opposite direction of the spinning direction inside the hollow guide shaft member 25.

Furthermore, by rotating the yarn feeding roller 30, the yarn tip of the leading yarn Y, projects from the guide hole 20 of the spinning nozzle 22 in cooperation with the air flow toward the fiber bundle inlet mentioned above, and the yarn tip of the leading yarn Y is held by being sucked by the suction pipe 34 provided between the spinning nozzle 22 and the front roller 15. Then, as shown in FIG. 10, the holding member 26 is joined with the nozzle block 24 again.

Then, the draft rollers (back roller 11 and third roller 12), which were stopped, are redriven, the sliver S is passed through the middle roller 13 and the front roller 15 and is delivered to the downstream side. At that time, the tip section of the sliver S is blown off by the pressurized air from the air shower tube 32 and is sucked and eliminated by the suction pipe 34 so that the guide hole 20 of the spinning nozzle 22 is not blocked.

Under the state in which the leading yarn (spun yarn) Y is held as in the manner stated above, the yarn feeding roller 30 is released from the yarn path, and starts running in the winding direction of the leading yarn Y by the nip roller 29 and the delivery roller 28. After redriving the injection of the whirling air flow from the nozzle hole 21, by stopping the injection of the pressurized air from the air shower tube 32, the fiber composing the sliver S is wound around the outer periphery of the leading yarn Y, the piecing is carried out and the spinning is recommenced.

However, there were problems in the piecing method and the piecing device of aforementioned conventional spinning machine as to be described in the following.

That is, since the distance between the air shower tube 32 and the sliver S is long, and the pressurized air hits the front roller 15 of the draft device 10, it was inefficient and there were cases in which the joint is bunched up together without the fiber, of which the fiber length is long and unlikely to be blown off to be eliminated completely.

Moreover, after stopping the injection of the pressurized air from the air shower tube 32, since the fiber amount of the sliver S, which is to enter the guide hole 20 of the spinning nozzle 22 for piecing, is the normal fiber amount; in other words, a fiber amount that is the same as the leading yarn Y, the joint thickness will be theoretically 2 times that of the leading yarn Y in cross section, and in diameter, 1.4 times.

These were the yarn defects, and there was a problem in that the quality of the spun yarn as a product decreases.

The object of the present invention is to solve the problems mentioned above, and to provide a piecing method and a piecing device of a spinning machine capable of blowing off the sliver effectively during piecing and controlling the joint thickness.

SUMMARY OF THE INVENTION

The present invention to achieve the object mentioned above, relates to a piecing method for blowing pressurized air to a sliver and sucking and guiding by a suction pipe provided between a twisting device and a draft device to carry out piecing to a leading yarn fed back to the twisting device and the sliver from the draft device, wherein the pressurized air is made to be blown in an opposing direction toward the sliver from the periphery of a spinning nozzle of the twisting device.

If constructed in accordance with the invention, the pressurized air can be blown from a position close to the sliver, and since there are no obstacles for the blowing, the sliver can be blown off efficiently.

Moreover, the pressurized air can be set to be weaker than the suction force of the spinning nozzle of the twisting device during piecing, and the joint thickness achieved by the piecing can be controlled to be a desired thickness by selecting the blowing time of the pressurized air.

Accordingly, the joint thickness can be controlled by blowing off and eliminating a part of the fiber of the sliver to enter the guide hole of the spinning nozzle.

Moreover, the present invention relates to a piecing method for blowing pressurized air to a sliver and sucking and guiding by a suction pipe provided between a twisting device and a draft device to carry out piecing of a leading yarn fed back to the twisting device and the sliver from the draft device, wherein an air nozzle for blowing pressurized air in a direction opposing the sliver delivered from the draft device is provided around a spinning nozzle of the twisting device.

BRIEF DESCRIPTION OF THE DRAWINGS

ü@ü@

DETAILED DESCRIPTION OF THE PREFERRED EMBODIMENTS

A preferred embodiment according to the present invention will now be described in reference to the accompanying drawings.

Figure 8:
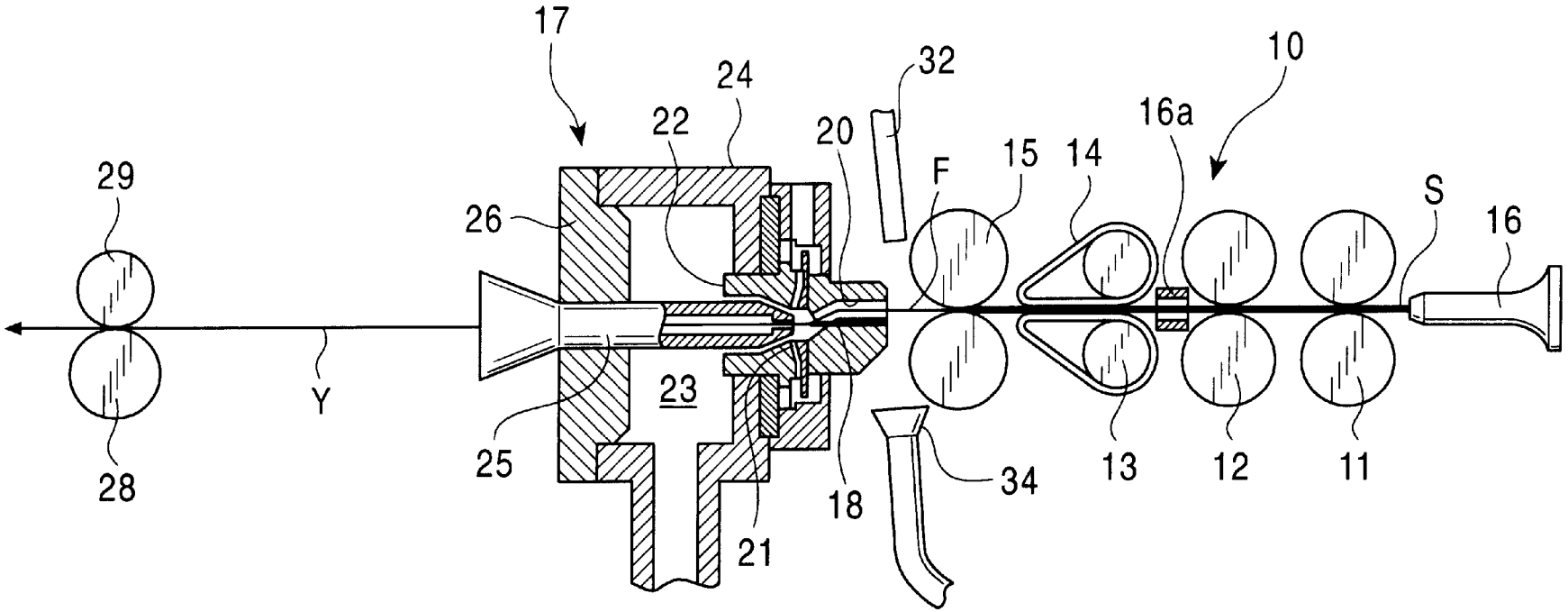
FIG. 8 PRIOR ART
FIG. 8 is a diagram showing the whole structure of the conventional spinning machine.
Figure 9:
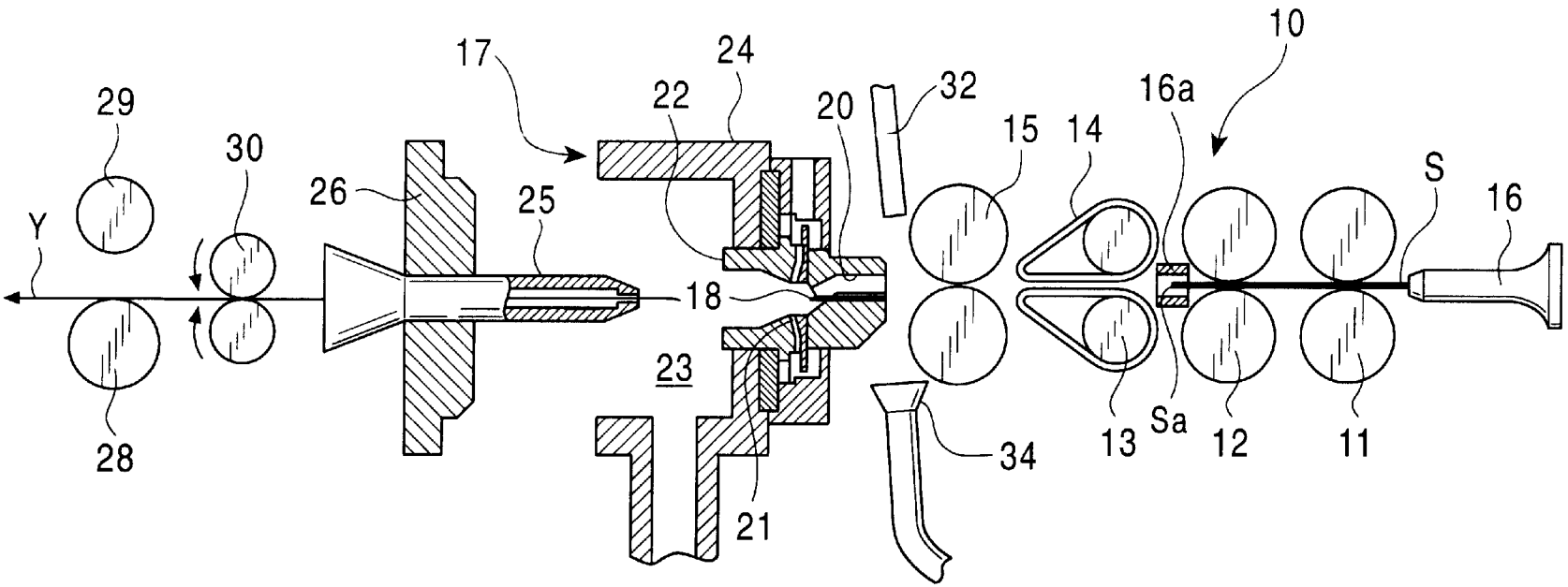
FIG. 9 PRIOR ART
FIG. 9 is a diagram showing the conventional piecing device and the method of the same.
Figure 10:
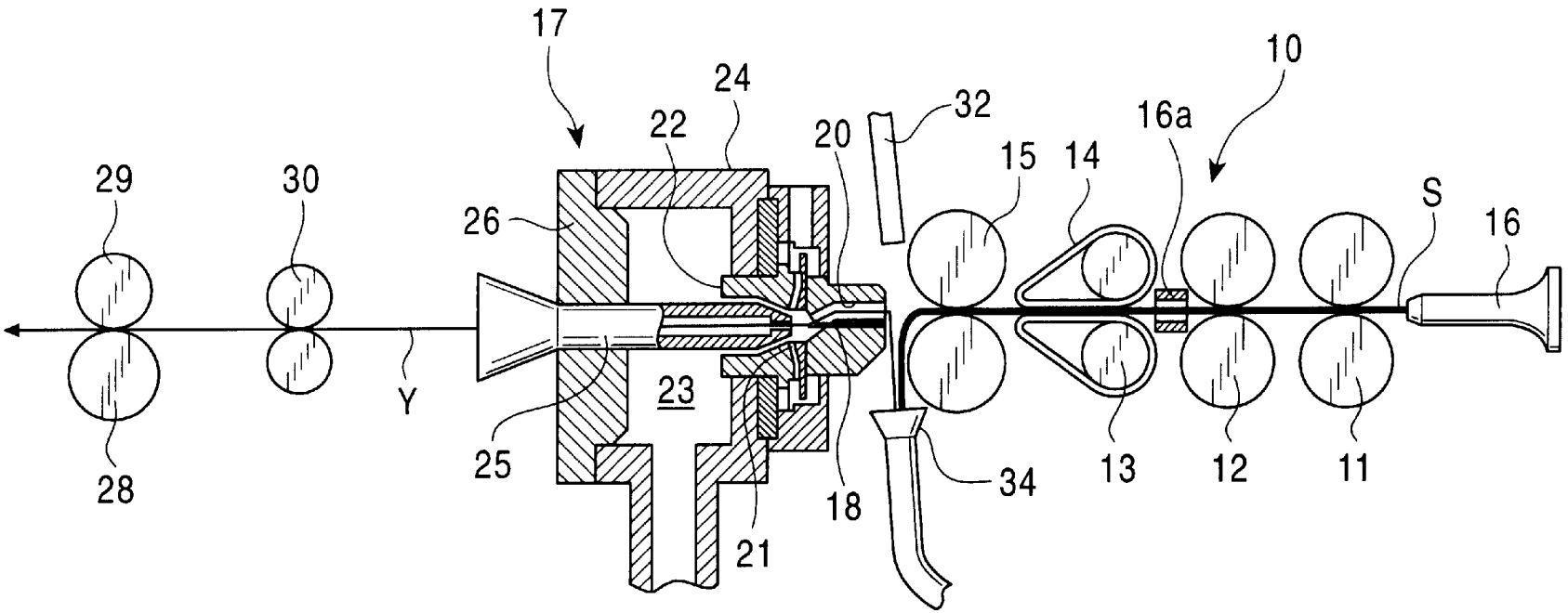
FIG. 10 PRIOR ART
FIG. 10 is a diagram showing the conventional piecing device in another condition of the method of the same.

The entire structure of the spinning machine according to an embodiment of the present invention is the same as the spinning machine illustrated in FIG. 8. Therefore, for the same members, the same reference numbers will be used and the description will be abbreviated.

The main point of the present invention is that an air nozzle 40 for injecting compressed air to the sliver S during piecing and for sucking the blown sliver into the suction pipe 34 is provided around the tip section of the spinning nozzle 22 of the twisting device 17.

Figure 1:
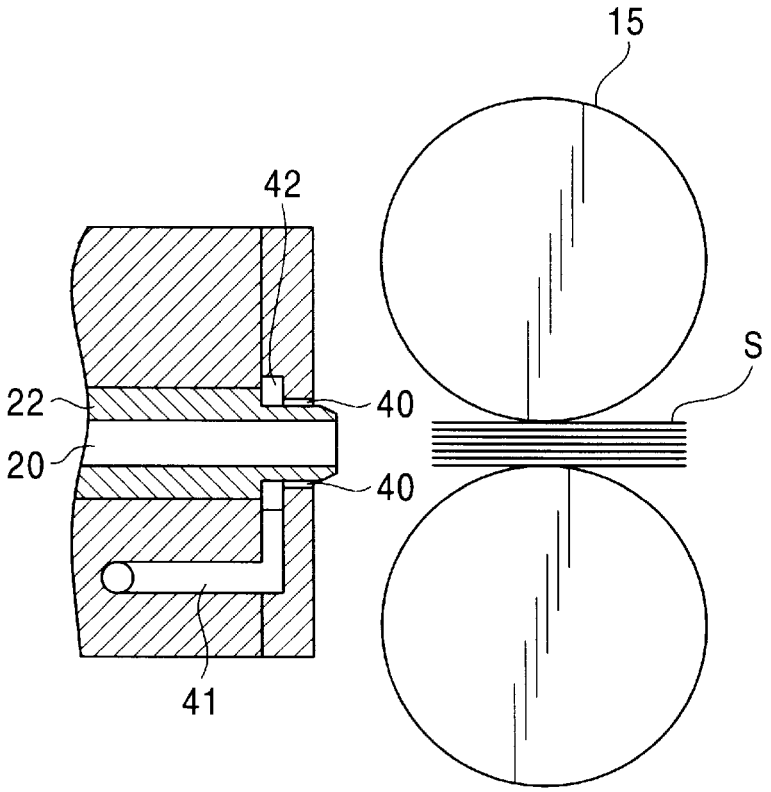
FIG. 1 is detailed partial sectional view showing a spinning nozzle and an air nozzle of a piecing device according to an embodiment of the present invention.
Figure 2:
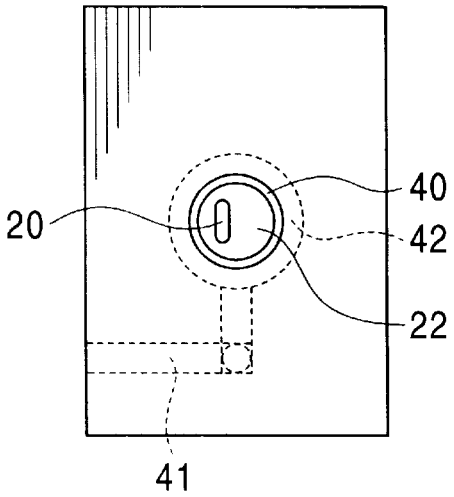
FIG. 2 is a front view of the spinning nozzle and the air nozzle of the piecing device according to an embodiment of the present invention.
Figure 3:
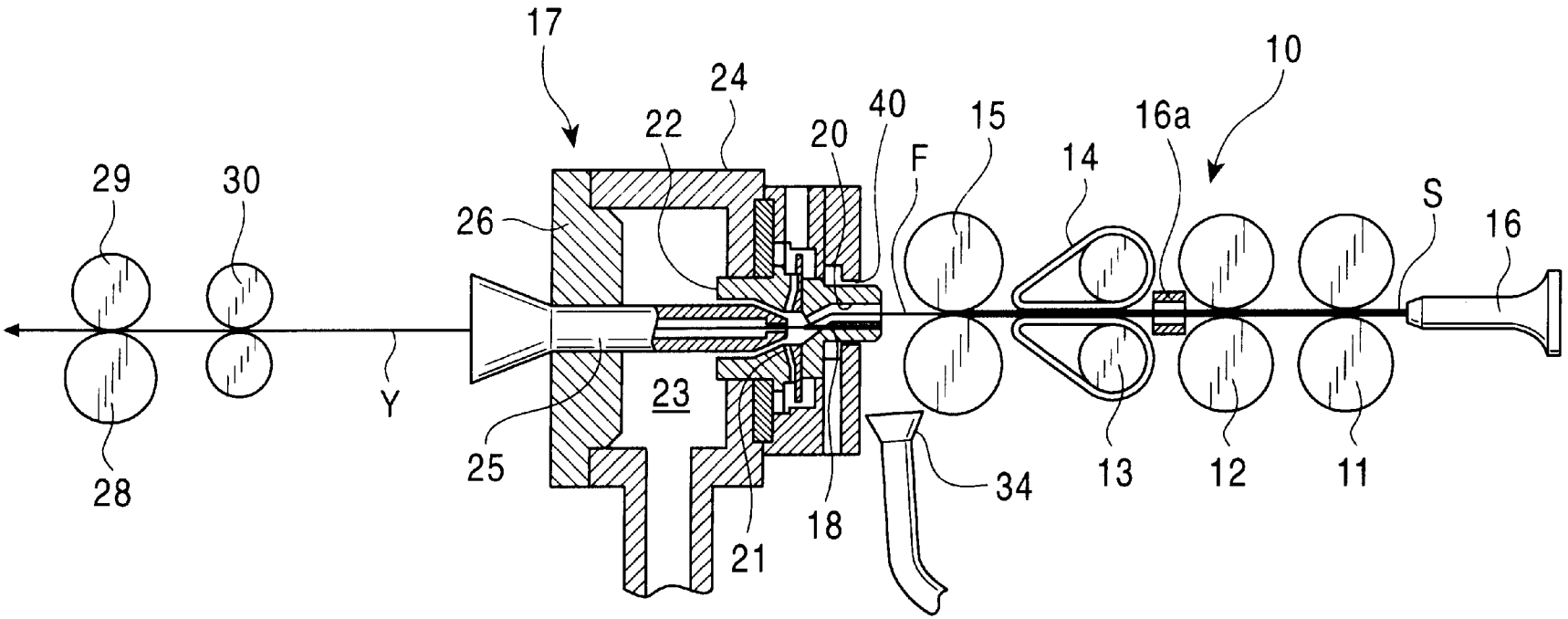
FIG. 3 is a diagram showing the entire spinning machine according to an embodiment of the present invention.

As shown in FIG. 1 and FIG. 2, the air nozzle 40 according to the embodiment of the present invention is formed in a circular form about the entire periphery of the periclinal of the spinning nozzle 22. In addition, an air passageway 41 connected to a compressed air supplying means which is not shown in the drawings, and an air manifold unit 42 for storing the pressurized air supplied to the air passage way 41 temporarily are connected to the air nozzle 40. The air manifold unit 42 is formed in a circular form along the entire periphery of the periclinal of the spinning nozzle 22, in the same manner as the air nozzle 40.

The pressurized air supplied into the air passage way 41 from the compressed air supplying means is stored in the air stocking unit 42 temporarily, and then injected from the air nozzle 40 toward the sliver S delivered from the front roller 15 of a draft device 10 in a direction opposed to the direction of movement of the sliver.

As is evident from the drawings, there are no obstacles between the air nozzle 40 and the sliver S which is delivered from the draft device 10, and the pressurized air from the air nozzle 40 can be blown reliably to the sliver S. Moreover, compared to the conventional air shower 32 illustrated in FIG. 8, the air nozzle 40 is capable of blowing pressurized air from a position closer to the sliver S.

The piecing operation after the yarn breakage in the spinning machine according to the embodiment of present invention provided with such air nozzle 40 will now be described.

The basic piecing operation is the same as the conventional piecing operation. When a yarn breakage occurs, first, the back roller 11 and the third roller 12 which are part of the draft rollers composing the draft device 10 are stopped while the middle roller 13 and the front roller 15 which are located the downstream side are kept in a driving state. At that time, the yarn delivery by the delivery roller 28 and the nip roller 29 is also maintained in a driving state for awhile. As a result, the sliver S is pulled from the middle roller 13 which is driving, and stops under the condition in which the tip section of the sliver S is located between the third roller 12 and the middle roller 13. At that time, the tip section of the sliver S is held by the second sliver guide 16*a*.

The driving (compressed air injection from the nozzle hole 21) of the twisting device 17 is stopped following the stopping of the aforementioned draft rollers of the draft device 10. Then, the hollow guide shaft member 25 is separated from the nozzle block 24. Under such state, preceding the piecing operation, the nip roller 29 is separated from the delivery roller 28 and the yarn delivery is stopped. Then, the spun yarn Y on the winding package P side is held by the yarn feeding roller 30 which comprises a yarn delivering member, and is back fed to the yarn discharging side of the twisting device 17 while being passed through the nip roller 29 and the delivery roller 28. The spun yarn Y is then fed toward the draft device 10 by the rotation of the yarn feeding roller 30, and in cooperation with an air flow (not shown in the drawings) toward the fiber bundle inlet of the guide hole 20 as a leading yarn, is inserted in the opposite direction of the spinning direction inside the hollow guide shaft member 25.

Furthermore, by rotating the yarn feeding roller 30, the yarn end of the leading yarn projects from the guide hole 20 of the spinning nozzle 22 in cooperation with the air flow toward the fiber bundle inlet, and the yarn tip of the leading yarn is sucked by the suction pipe 34 provided between the nozzle 22 and the front roller 15 and is held thereby. Then, the holding member 26 is fit into the nozzle block 24 again and the piecing preparation is completed.

Then, the draft rollers (back roller 11 and third roller 12), which were stopped, are redriven, and the sliver S is passed through the middle roller 13 and the front roller 15 and is delivered to the downstream side. At that time, the pressurized air is blew out from the air nozzle 40 provided around the spinning nozzle 22 to oppose toward the sliver S fed from the draft device 10, the tip section of the sliver S is blown off, sucked into and eliminated by the suction pipe 34. As a result the fiber is prevented from getting clogged in the guide hole 20.

Under such state in that the leading yarn (spun yarn) Y is held, the yarn feeding roller 30 is released from the yarn path, and the running in the winding direction of the leading yarn Y by the nip roller 29 and the delivery roller 28 are started, and after the injection of the whirling air flow from the nozzle hole 21 is redriven, by stopping the injection of the pressurized air from the air nozzle 40, the fiber comprising the sliver S is wound around the leading yarn Y and the piecing is carried out. The spinning operation is then restarted.

Figure 4:
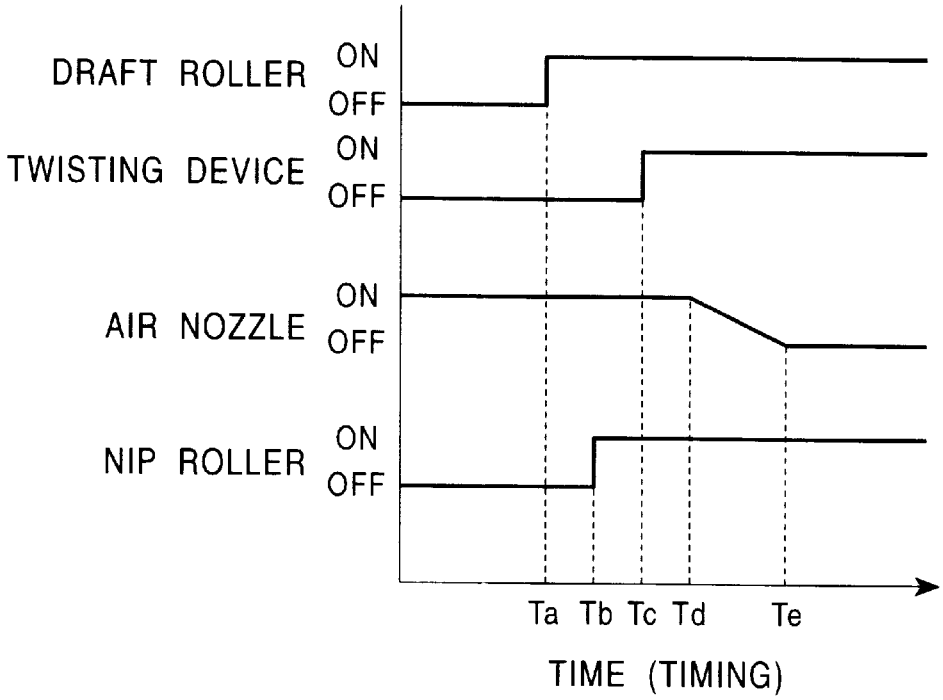
FIG. 4 is a time chart showing the driving timing of each device during piecing.

FIG. 4 is a time chart showing the driving timing of the draft rollers (back roller 11 and third roller 12), the twisting device 17 (compressed air injection from the nozzle hole 21), the air nozzle 40 and the nip roller 29, after the piecing preparation is completed by holding the yarn tip of the leading yarn by the suction pipe 34. Referring to FIG. 4, the driving timing of each device will be described.

First, when the yarn tip of the leading yarn is held by the suction pipe 34, the air nozzle 40 is put "ON", and the pressurized air is blown to the sliver S and the yarn tip is blown off. As a result, the fiber is prevented from being clogged in the guide hole 20 of the spinning nozzle 22. At that time, the draft rollers 11,12, the twisting device 17 and the nip roller 29 are put "OFF", and are stopped.

Then, the draft rollers 11,12 are put "ON" at time Ta, and the sliver S is delivered to the downstream side through the middle roller 13 and the front roller 15. At that time, the air nozzle 40 is still put "ON".

Next, at time Tb, somewhat later than time Ta, the time the draft rollers 11,12 are put "ON", the nip roller 29 is put "ON" and the running of the leading yarn Y in the winding direction by the nip roller 29 and the delivery roller 28 is started.

Then, at time Tc, the twisting device 17 is put "ON" and the piecing is carried out.

Lastly, at time Td, the air nozzle 40 is put "OFF", and the air inside the air manifold unit 42 is injected gradually from the air nozzle 40. At time Te, the injection of the compressed air from the air nozzle 40 is stopped completely.

According to the embodiment of the present invention, since the pressurized air is injected to oppose the sliver S which is delivered by the draft device 10 from the periphery of the spinning nozzle 22, there are no obstacles to air blowing and the operation efficiency is high.

Moreover, compared to the conventional device, since the pressurized air is injected from a position closer to the sliver S, the sliver S can be blown off efficiently, wherein the fiber of which is less prone to be blown off, such as long fiber, can also be blown off reliably.

Furthermore, according to the present invention, by setting the force of the pressurized air from the air nozzle 40 to be weaker than the suction force of the spinning nozzle 22 of the twisting device 17 during piecing, and selecting the blowing time of the pressurized air, the joint thickness produced by the piecing can be controlled to be a desired value.

In other words, by blowing pressurized air from the air nozzle 40 in a direction toward the sliver S from the draft device 10 which is to be inserted into the guide hole 20 of the spinning nozzle 22, and blowing off and eliminating a part of the fiber composing the sliver S, the joint thickness can be controlled. The force of the pressurized air from the air nozzle 40 was set to be weaker than the suction force of the spinning nozzle 22, because, when the force of the pressurized air is stronger than the suction force of the spinning nozzle 22, all of the fiber of the sliver S fed from the draft device 10 is blown off without entering the guide hole 20.

Next, referring to FIG. 5, the relationship between the stop timing of the air nozzle and the joint thickness will be described.

In the figure, the horizontal line shows the timing for stopping the air nozzle, and the stop timing slows down by going to the right, and shows that the blowing time is long. The vertical line shows the joint thickness, and 1 shows that the thickness is the same as the leading yarn Y.

First, from point (a) to point (b), the stop timing of the air nozzle 40 is fast, and since the blowing of the pressurized air stops before the sliver S reaches the spinning nozzle 22, the fiber of the sliver S is not blown off at all. Therefore, the amount of fiber of the sliver S entering the spinning nozzle 22, is to be the normal fiber amount (the same yarn amount as leading yarn Y), and the diameter of the joint thickness will be theoretically 1.4 times that of the leading yarn Y, as in the same manner as the conventional technology.

Then, as the stop timing of the air nozzle 40 is reduced from that of point (b), the joint thickness gradually gets thin since the fiber amount decreases by a part of the fiber of the tip section of the sliver S being blown off by the pressurized air.

Point (d) shows that the joint thickness gets to the ideal thickness which is almost the same as the thickness of the leading yarn Y. The stop timing of the air nozzle 40 at point (d) is the same as the timing in which the tip section of the leading yarn Y enters the guide hole 20 of the spinning nozzle 22.

From point (d) to point (c), the stop timing of the air nozzle 40 is slow, and the joint thickness from the end section of the leading yarn Y to the back section will be thinner than the thickness of the leading yarn Y.

Furthermore, when the stop timing of the air nozzle 40 slows down and passes over point (e), the piecing cannot be carried out.

Considering various conditions, such as the transferring speed of the leading yarn Y and the sliver S, by setting the stop timing of the air nozzle 40 at point (d), the joint thickness can be made nearer to the thickness of the leading yarn Y, and the quality of the spun yarn as a product can be improved by preventing the generation of yarn defects.

Figure 5:
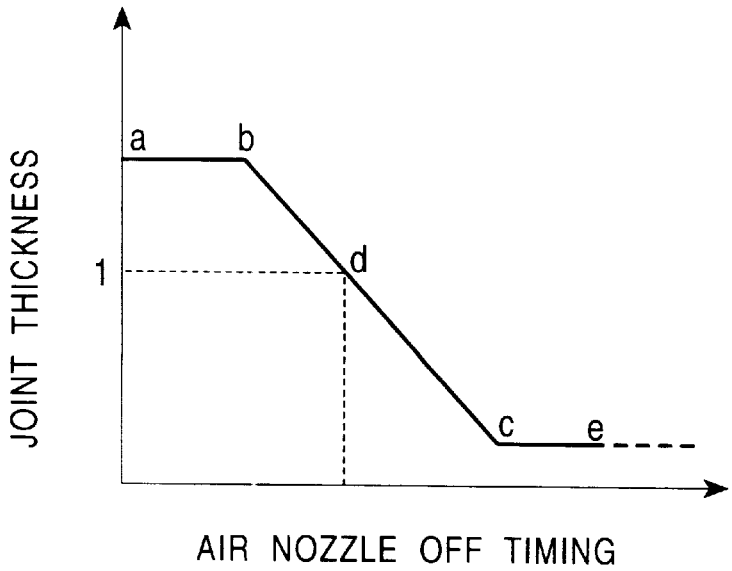
FIG. 5 is a diagram showing the relationship between the stop timing of the air nozzle and the joint thickness.

By lengthening the time between the stopping of the air nozzle 40 to the complete stopping of the blowing of the pressurized air, in other words, by softening the decrease in the pressure of the air, the tendency between point (b) through point (c) of FIG. 5 can be softened. The softening in the tendency of point (b) through point (c) has an effect in that the setting of the stop timing of the air nozzle 40 is facilitated.

For softening the decrease in the pressure of the pressurized air, for example, the length of the pipe between the valve (not shown in the drawings) of the air compressing means and the air nozzle 40 can be lengthened, or the number of parts on the valve can be decreased.

Figure 6:
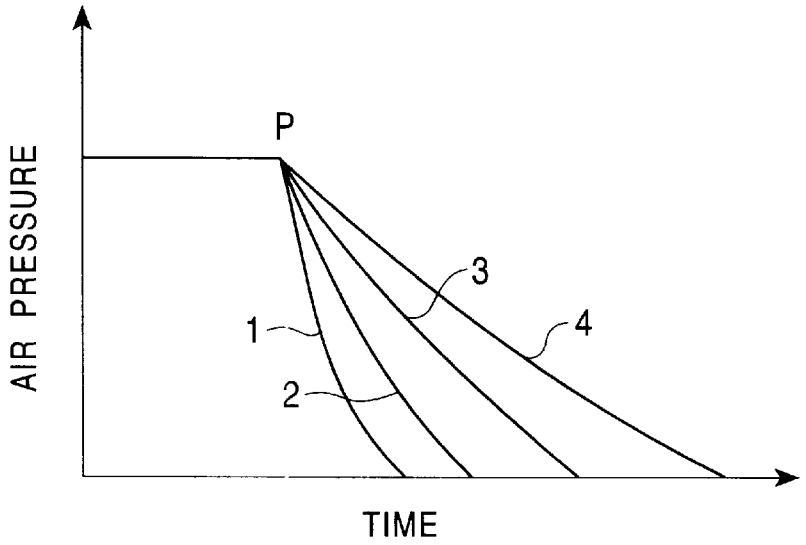
FIG. 6 is a diagram showing the relationship between the length of the pipe from a valve to the air nozzle and the port number of the valve, and the decrease in the pressure of the air after the stopping of the air nozzle.

Referring to FIG. 6, the relationship between the length of the pipe between the valve (not shown in the drawings) of the air compressing means and the air nozzle 40, the number of ports in of the valve, and the decrease in the pressure of the air after the stopping of the air nozzle 40 will be described.

In the figure, point P indicates the stop timing of the air nozzle 40, line 1 indicates the state in which the pipe length is 20 cm and the port number of the valve is 3, line 2 indicates the state in which the pipe length is 20 cm and the port number of the valve is 2, line 3 indicates the state in which the pipe length is 220 cm and the port number of the valve is 3, and line 4 indicates the state in which the pipe length is 220 cm and the port number of the valve is 2.

As is evident from the figure, when lengthening the pipe length, the decrease in the pressure of the pressurized air softens since the pipe serves as a tank and suppresses the decrease in the pressure. Moreover, by decreasing the port number of the valve, the decrease in the pressure of the pressurized air softens since when the port number of the valve is large, the pressurized air leaks from the port and the decrease in the pressure becomes intense. Thus, by decreasing the port number of the valve, the pressurized air leaking from the port can be prevented.

The air manifold unit 42 shown in FIG. 1 and FIG. 2 is provided to soften the decrease in the pressure of the pressurized air. Therefore, the present invention is not to be limited to the embodiments illustrated in the drawings and the air manifold unit 42 is not required to be provided.

Figure 7:
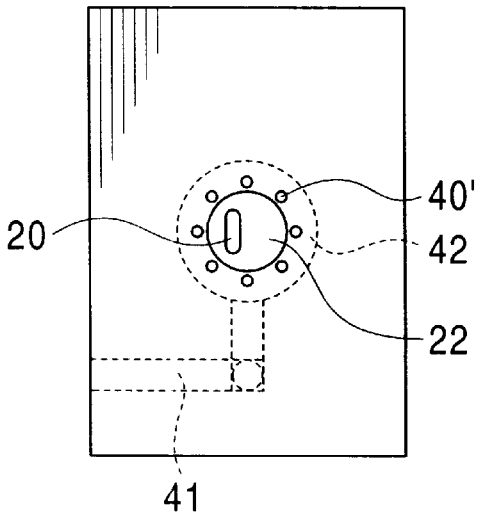
FIG. 7 is a diagram showing another embodiment of the air nozzle.

Moreover, referring to FIG. 1 and FIG. 2, it was described that the air nozzle 40 is to be provided in a circular form about the entire periphery of the spinning nozzle 22, however, the present invention is not to be limited to this configuration, and for example, as shown in FIG. 7, a plurality of air nozzles 40' can be provided around the spinning nozzle 22.

According to the present invention described above, the following beneficial effects can be expected.

Since the pressurized air can be blown toward the sliver efficiently and reliably, the sliver can be blown off completely, and the generation of yarn defects can be prevented.

By controlling the joint thickness, the joint thickness can be made to be closer to that of the thickness of the leading yarn.

Since the distance from the air nozzle to the sliver is close, the pressure control of the pressurized air blown is easy.

What is claimed is:

1. A piecing method of a spinning machine in which pressurized air is blown to a sliver and in which the blown sliver is sucked and guided by a suction pipe provided between a twisting device and a draft device to carry out piecing to a leading yarn fed back to the twisting device of the sliver from the draft device, said method including the step of:

blowing pressurized air from the periphery of a spinning nozzle of the twisting device in a direction opposite to a direction of feeding the sliver.

2. A piecing method of a spinning machine according to claim 1 wherein a force of the pressurized air is set to be weaker than the suction force of the spinning nozzle of the twisting device during piecing, and including the step of controlling joint thickness by the piecing method to a desired value by selecting a blowing time of the pressurized air.

3. A piecing device of a spinning machine for blowing pressurized air to the sliver sucked and guided by a suction pipe provided between a twisting device and a draft device to carry out piecing of a leading yarn fed back to the twisting device and the sliver from the draft device, comprising:

an air nozzle disposed around a spinning nozzle of the twisting device for blowing pressurized air in opposition to the sliver delivered from the draft device.

* * * * *